United States Patent [19]

Sakashita

[11] Patent Number: 4,666,813

[45] Date of Patent: May 19, 1987

[54] DEVELOPER FOR DEVELOPING ELECTROSTATIC LATENT IMAGES CONTAINS VINYLIDENE FLUORIDE POLYMER

[75] Inventor: Kiichiro Sakashita, Kawasaki, Japan

[73] Assignee: Canon Kabushiki Kaisha, Tokyo, Japan

[21] Appl. No.: 815,904

[22] Filed: Jan. 3, 1986

[30] Foreign Application Priority Data

Jan. 8, 1985 [JP] Japan ..... 60-1775
Jan. 31, 1985 [JP] Japan ..... 60-17071

[51] Int. Cl.[4] ..... G03G 9/08
[52] U.S. Cl. ..... 430/110; 430/125
[58] Field of Search ..... 430/110, 125

[56] References Cited

U.S. PATENT DOCUMENTS 3,761,413 9/1973 Hulse ..... 430/109
4,051,077 9/1977 Fisher ..... 430/110
4,139,483 2/1979 Williams et al. ..... 430/110
4,187,329 2/1980 Crooks ..... 430/110
4,423,192 12/1983 Van Lang et al. ..... 525/199

*Primary Examiner*—John D. Welsh
*Attorney, Agent, or Firm*—Fitzpatrick, Cella, Harper & Scinto

[57] ABSTRACT

A developer for developing electrostatic latent images, comprising toner particles and particles of a fluorine-containing substance as represented by a vinylidene fluoride polymer having a specific randomness in molecular structure or crystalline structure. The randomness of the vinylidene fluoride polymer is defined by the absorption peak ratio in the $F^{19}$ nuclear magnetic resonance spectrum in acetone or by the absolute $\beta$-crystal content of the vinylidene fluoride polymer. The vinylidene fluoride polymer provides a friction reducing characteristic to the developer while retaining good developing characteristic under various conditions.

20 Claims, 4 Drawing Figures

DEVELOPER FOR DEVELOPING ELECTROSTATIC LATENT IMAGES CONTAINS VINYLIDENE FLUORIDE POLYMER

FIELD OF THE INVENTION AND RELATED ART

The present invention relates to a novel developer for use in image forming processes such as electrophotography, electrostatic recording and magnetic recording.

In the electrophotography, electrostatic latent images are formed by utilizing photoconductivity of such materials as cadmium sulfide, polyvinylcarbazole, selenium and zinc oxide. More specifically, an electric charge is uniformly applied to a photosensitive member having a photoconductor layer and the photosensitive member is subjected to imagewise exposure to form an electrostatic latent image, which is then developed with a powdery toner charged in a polarity opposite to or, in the case of reversal development, in the same polarity as that of the electrostatic latent image. The resultant toner image is then transferred to a transfer sheet, as desired, and fixed. In a process or apparatus involving a transfer step, a portion of the toner not transferred but remaining on the photosensitive member is generally removed and the photosensitive member is repeatedly used. In order to remove the toner remaining on the photosensitive member, it is a general practice to have a cleaning member contact the photosensitive member as in the blade cleaning system, the fur brush cleaning system and the magnetic brush cleaning system. In this case, as the cleaning member contacts the photosensitive member under an appropriate pressure, difficulties are encountered such as the photosensitive member is mechanically damaged or the toner sticks thereto on a repetitive use of the photosensitive member. When the cleaning is not properly effected, the electrostatic latent image formed on the photosensitive member is disturbed, so that practically unacceptable toner images are obtained containing spot or streak like irregularities. In order to obviate the sticking of a toner on a photosensitive member, it is known to add a friction reducing substance in the toner. This method prevents a poor cleaning problem such as toner sticking but is accompanied with several difficulties as follow. In this regard, a large amount of a known friction reducing substance is required in order to show a sufficient effect under high temperature-high humidity conditions. However, when such a substance is added in a large amount, other difficulties are encountered such that clear images cannot be obtained, and low electrically resistive substances such as paper dust and ozone adducts are formed on or attached to the surface of the photosensitive member which during repetitive use cannot readily be removed, whereby latent images on the photosensitive member are remarkably impaired especially under high temperature-high humidity environmental conditions.

Use of a friction reducing substance such as polyvinylidene fluoride powder is known as in, e.g., Japanese Patent Publications Nos. 8136/1973 (corr. to U.K. Pat. No. 1,272,815), 8141/1973 (corr. to U.S. Pat. No. 4187329) and 1130/1976 (corr. to U.K. Pat. No. 1,321,651). As a result of our study for resolving the above problems, problems accompanying poor cleaning such as toner sticking can be obviated by the use of a known friction reducing substance such as polyvinylidene fluoride when it is used in a large amount. On the other hand, the accompanying problems such as remarkable lowering in image clarity, disturbance of latent images on a photosensitive member under high temperature-high humidity conditions, unstability in a long period of use, and liability of damaging a photosensitive member, have not been sufficiently resolved. Accordingly, a further excellent friction reducing substance is desired to be provided.

SUMMARY OF THE INVENTION

A general object of the present invention is to provide a developer having solved the above mentioned problems.

A specific object of the present invention is to provide a developer which does not cause a disturbance of electrostatic latent images even under high temperature-high humidity conditions.

Another object of the present invention is to provide a developer giving clear toner images.

Still another object of the present invention is to provide a developer which is triboelectrically charged stably in a successive copying operation and is capable of providing good images for a long period of time.

A further object of the present invention is to provide a developer having little tendency to cause toner sticking onto a photosensitive member or flaw of a photosensitive member with a toner component.

According to the present invention, there is provided a developer for developing electrostatic latent images, comprising toner particles and particles of a fluorining-containing substance, the fluorine-containing substance satisfying the following relationship based on the $F^{19}$ nuclear magnetic resonance spectrum thereof taken in the form of an acetone solution:

$$(Sb+Sc+Sd)/Sa \geqq 0.20,$$

wherein Sa, Sb, Sc and Sd are areas of absorption peaks at about $-23.5\pm1$ ppm, about $-27.5\pm1$ ppm, about $-45.8\pm1$ ppm, and about $48.1\pm1$ ppm, respectively with 1,1,2-trichloro-1,2,2-trifluoroethane as the reference substance.

According to another aspect of the present invention, there is provided a developer for developing electrostatic latent images, comprising toner particles and particles of a vinylidene fluoride polymer having an absolute $\beta$-crystal content of 0.30 or above.

These and other objects, features and advantages of the present invention will become more apparent upon consideration of the following description of the preferred embodiments of the present invention taken in conjunction with the accompanying drawings.

DETAILED DESCRIPTION OF THE INVENTION

Figure 1:
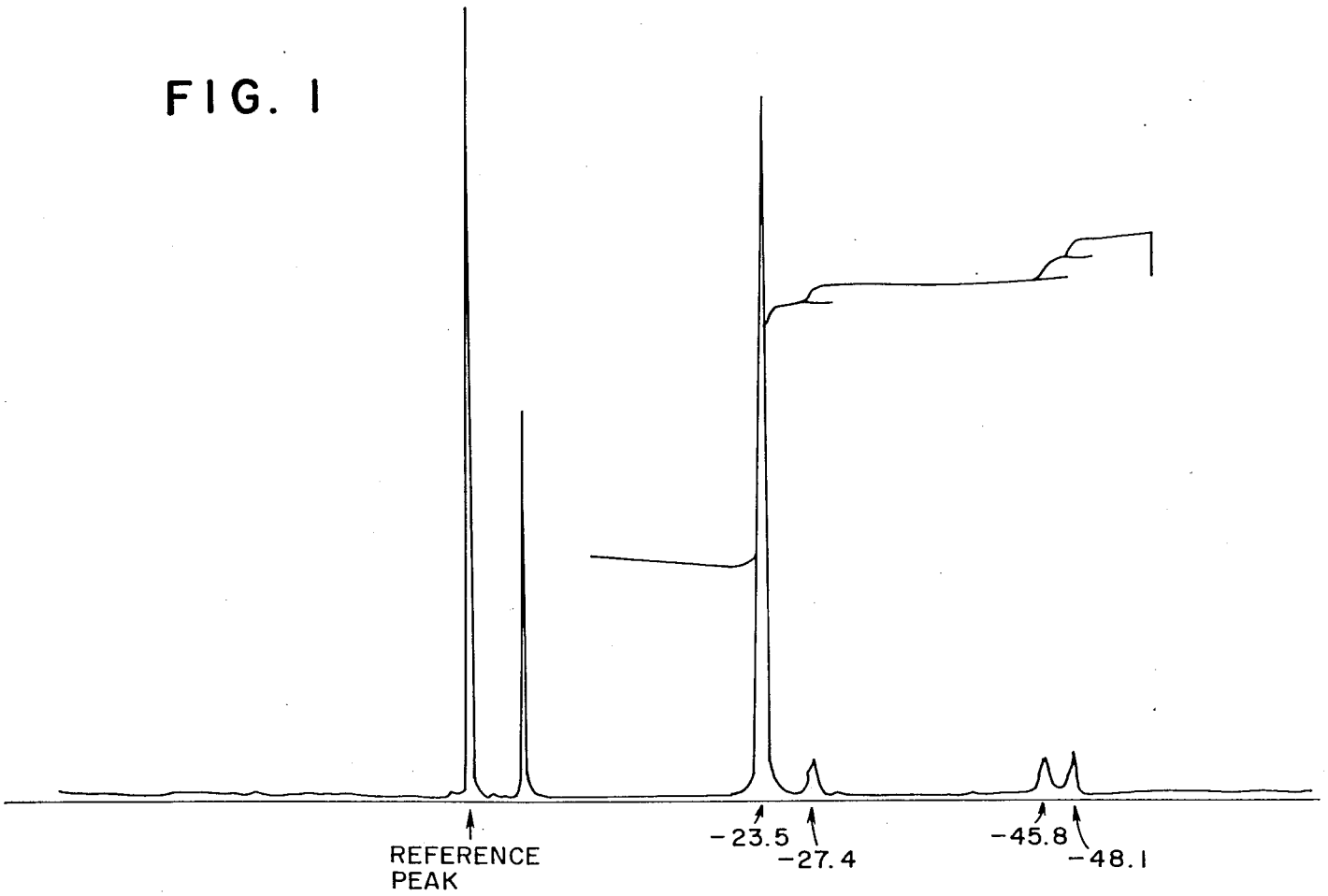
FIG. 1 is a chart of the $F^{19}$ nuclear magnetic resonance of the developer used in Example 1.

A characteristic feature of the developer according to the present invention is that it contains particles of a fluorine-containing substance showing absorption peaks at about $-23.5\pm1$ ppm, about $-27.5\pm1$ ppm, about $-45.8\pm1$ ppm and about $-48.1\pm1$ ppm according to the $F^{19}$ nuclear magnetic resonance (hereinafter, sometimes referred to as "$F^{19}$-NMR") having peak areas Sa, Sb, Sc and Sd, respectively, which satisfy the relationship:

$$(Sb+Sc+Sd)/Sa \geqq 0.20.$$

The $F^{19}$-NMR absorption spectrum used in the present invention corresponds to chemical shifts of $—CF^*_2—$ in a vinylidene fluoride polymer as shown in, e.g., J. Polymer Sci. A1, page 1305 (1963).

More specifically, the absorption peak at $-23.5$ ppm corresponds to an absorption based on a regular head-tail repetition of $—CF_2—CH_2—$ units. The absorption peak at $-27.5$ ppm is an absorption by $CF^*_2$ in a chain containing a $—CH_2—CH_2—$ bond such as $—CH_2—CH_2—CF^*_2—CH_2—CF_2—$. The absorption peak at $-45.8$ ppm is an absorption by $CF^*_2$ in a chain containing a $—CF_2—CF_2—$ bond such as $—CH_2—CF^*_2—CF_2—CH_2—$. The absorption peak at $-48.1$ ppm is an absorption by $CF^*_2$ in a chain containing both a $—CH_2—CH_2—$ bond and a $—CF_2—CF_2—$ bond.

We have discovered that the above mentioned problems can be overcome by using a fluorine-containing substance showing a proportional relationship of $(Sb+Sc+Sd)/Sa \geqq 0.20$ (wherein Sa, Sb, Sc and Sd are absorption peak areas at about $-23.5$, about $-27.5$, about $-45.8$ and about $-48.1$ ppm, respectively) showing the ratio between the peak areas given by the abnormal linkages and that given by the regularly repeating linkage. Thus, clear and stable images can be obtained without disturbance in latent images under high temperature-high humidity conditions and with little staining due to poor cleaning.

The NMR peak ratio condition of $(Sb+Sc+Sd)/Sa \geqq 0.20$ according to the invention shows that the developer according to the invention contains a vinylidene fluoride polymer containing a large proportion of abnormal linkages, i.e., containing a large proportion of linkages or structures wherein the $—CF_2—CH_2—$ unit is not regularly arranged. This is contrary to the conventional concept of trying to obtain a polymer which is as uniform as possible in order to enhance the mechanical properties and lower the surface free energy. In other words, we have discovered that the abnormal linkages are important in order to accomplish the objects of the present invention and had a knowledge that the desired effects can be attained by using a fluorine-containing substance satisfying the NMR peak ratio condition of $(Sb+Sc+Sd)/Sa \geqq 0.20$.

The fluorine-containing substance shows an appropriate abrasive characteristic as well as high lubricity, so that the attachment of toner and paper dust can be obviated to provide stainless, clear images even under high temperature-high humidity conditions of 32.5° C.-90% R.H. Further, in the developer according to the present invention, a uniform toner charge can be obtained to provide stable images with a high image density during a long period of successive copying operation. This may be attributable to a high dielectric characteristic of the fluorine-containing substance wherein $CF_2$ units align in the same direction locally in a unit lattice so as to readily provide a conformation yielding a large dipole moment.

The unique effect attained by using a substance selected based on physical properties evaluated according to a specified peak ratio in a $F^{19}$ NMR spectrum has not been suggested heretofore.

It is preferred that the developer according to the invention (substantially due to the fluorine-containing substance contained therein) shows a peak ratio due to the chemical shifts of $CF^*_2$ according to the $F^{19}$-NMR satisfying the relationship of: $(Sb+Sc+Sd)/Sa \geqq 0.20$ and also the relationship of $(Sb+Sc+Sd)/Sa < 0.5$.

The measurement according to the $F^{19}$-NMR is effected in the following manner. A sample is subjected to extraction at a temperature from room temperature to 50° C., and a solution thereof in acetone or deuterium acetone is used for the measurement. A specific measurement was effected by using a high resolving power NMR apparatus, model FX-90Q, mfd. by Nihon Denshi K.K. under the conditions of an observation frequency of about 84.25 MHz, an observation range of about 9000 Hz, and an offset frequency of about 55.33 KHz. The chemical shifts were measured with the use of 1,1,2-trichloro-1,2,2-trifluoroethane as the reference substance. Four chemical shifts were found at $-23.5\pm1$ ppm, $-27.5\pm1$ ppm, $-45.8\pm1$ ppm and $-48.1\pm1$ ppm. The chemical shifts obtained for a vinylidene fluoride polymer alone, and a developer containing a toner and the vinylidene fluoride polymer, respectively, in the form of extracts, were found to be substantially the same. The values Sa, Sb, Sc and Sd were measured from the integrated values for the these peaks.

The fluorine-containing substance to be used in the present invention is represented by a vinylidene fluoride polymer. Herein, the term "vinylidene fluoride polymer" is used to cover homopolymer of vinylidene fluoride (polyvinylidene fluoride) and also a copolymer of vinylidene fluoride with a monomer copolymerizable therewith such as ethylene, vinyl fluoride, trifluoroethylene, and tetrafluoroethylene. The ratio of vinylidene fluoride and another monomer in the copolymer may preferably be 95–50:5–50, particularly 80–70:20–30 in terms of a weight ratio.

The vinylidene fluoride polymer should preferably be used in the form of particles having a particle size of 0.05 to 1 μm, particularly 0.1 to 0.5 μm. If the particle size is above 1.0 μm, the polymer particles cannot be sufficiently dispersed between the toner particles but fail to impart sufficient flowability and lubricity to the toner so that the effect thereof cannot be fully exhibited. On the other hand, if the particle size is below 0.05 μm, the surface of the toner particles are covered with fine particles of the polymer to impair the chargeability of the toner. The polymer particles should preferably have shapes close to spheres. The vinylidene fluoride polymer particles according to the invention should preferably have a good flowability as represented by a relatively small angle of repose. More specifically, the polymer particles should preferably have a repose angle of 10° to 35°, particularly 20° to 30°. The repose angle herein is based on the values measured according to the following method. A powder tester mfd. by Hosokawa Micron K.K. is used and a powder sample is caused to flow down at almost the center of a round table of 8 cm in diameter for measuring a repose angle through a funnel. The flowing down is continued until the powder begins to fall down from the periphery of the table and the state of the pile of the powder on the table becomes constant, when the sample powder is stopped from falling down. The repose angle of the sample powder in this state is measured by a protractor.

The specific vinylidene fluoride polymer according to the present invention should preferably be added to the toner in an amount of 0.01 to 2.0 wt.%, particularly 0.02 to 1.0 wt.%, respectively, based on the weight of the toner. If the amount is above 2.0 wt.%, a problem such as decrease in image density can occur, and the amount of less than 0.01 wt.% can not sufficiently improve the lubricity of the toner.

The vinylidene fluoride polymer according to the invention may preferably have a weight-average molecular weight of 100,000 to 800,000, particularly 200,000 to 600,000.

It is possible to use the vinylidene fluoride polymer particles after surface-treatment with a surfactant, a charge modifier, etc.

The particle size mentioned above of the vinylidene fluoride polymer is a number-average particle size of primary particles based on measurement with a photograph of secondary electron image taken at a magnification of 20,000 to 50,000 through a scanning electron microscope. The weight average molecular weight Mw mentioned above is based on measured values obtained by a gel permeation chromatography (GPC) under the conditions; a temperature: 40° C., a solvent: tetrahydrofuran (THF), an elution rate: 1.0 ml/min. and a sample volume and concentration: 300 μl of a 0.1 wt.% THF solution of the sample. The calibration curve was prepared in advance by using monodiperse polystyrene standard samples for the measurement of molecular weights of samples. A Shodex A-80 column was used for example.

In the present invention, particles of a vinylidene fluoride polymer having an absolute content of β(-phase) crystal of 0.30 or more in terms of a weight ratio may also be used as a preferable additive of the developer.

The developer containing a vinylidene fluoride polymer having an absolute β-crystal content of 0.30 or more has a high lubricity and an appropriate abrasive characteristic in combination, so that attachment of the toner or paper dust onto the photosensitive member can be obviated to provide stainless, clear images even under high temperature-high humidity conditions of 32.5° C.—95% R.H.

Heretofore, it has been proposed to increase the crystallinity of a vinylidene fluoride polymer in order to enhance the mechanical properties. The increase in crystallinity, in a sense, means an increase in regularity of the vinylidene fluoride polymer. In contrast thereto, the β-crystals as a characteristic of the invention may rather be formed readily in case where the vinylidene fluoride polymer contains irregular linkages caused by randomness in head-to-tail linkages of vinylidene fluoride units. Thus, the concept of the invention is utterly different from the conventional concept.

Further, in the developer according to the invention, a uniform toner charge can be obtained thereby to provide stable toner images with a high image density during a long period of successive copying operation. This may be attributable to a high dielectric characteristic of the vinylidene fluoride polymer wherein $CF_2$ units align in the same direction locally in a unit lattice so as to readily provide a conformation giving a large dipole moment.

The vinylidene fluoride polymer according to the invention should have an absolute β-crystal content of 0.30 or more. Herein, the absolute β-crystal content is defined as the -crystal portion of the total vinylidene fluoride polymer including its crystal portion and the amorphous portion. The absolute β-crystal content should more preferably be 0.35 or more. Below 0.30, the objective effect according to the present invention cannot be fully achieved because the β-crystal is too little.

The vinylidene fluoride polymer comprising β-crystal may include homopolymer of vinylidene fluoride and a copolymer of vinylidene fluoride with a monomer copolymerizable therewith including a fluorine-containing monomer such as vinyl fluoride, trifluoroethylene and tetrafluoroethylene, and an olefin monomer such as ethylene, propylene, and butene.

The vinylidene fluoride polymer to be used in the invention may be in the form of powder as it is obtained through polymerization or may be used after annealing it through a heat treatment. The effect of the invention may also be obtained by using fine product obtained through pulverization of stretched film or monofilaments of the vinylidene fluoride polymer.

The vinylidene fluoride polymer should preferably be used in the form of particles, particularly spherical ones, having a particle size of from 0.05 to 1 μm, particularly 0.1 to 0.5 μm. If the particle size is above 1.0 μm, the polymer particles cannot be sufficiently dispersed between the toner particles but fail to impart sufficient flowability and lubricity to the toner so that the effect thereof cannot be fully exhibited. On the other hand, if the particle size is below 0.05 μm, the surface of the toner particles are covered with fine particles of the polymer to impair the chargeability of the toner. The polymer particles should preferably have shapes close to spheres and have a good flowability represented by a repose angle of 10°–35°, preferably 20°–30°.

The specific vinylidene fluoride polymer according to the present invention should preferably be added to the toner in an amount of 0.01 to 2.0 wt.%, particularly 0.02 to 1.0 wt.%, respectively, based on the weight of the toner. If the amount is above 2.0 wt.%, a problem such as decrease in image density can occur, and the amount of less than 0.01 wt.% cannot sufficiently improve the lubricity of the toner.

The vinylidene fluoride polymer according to the invention may preferably have a weight-average molecular weight of 100,000 to 800,000, particularly 200,000 to 600,000.

It is possible to use the vinylidene fluoride polymer particles after surface-treating them with a surfactant, a charge modifier, etc.

In order to evaluate the absolute β-crystal content of a vinylidene fluoride polymer, it is necessary to measure the crystalline portion (crystallinity) including α-crystal and β-crystal of the polymer. There are several methods for measurement of the crystallinity, and respective methods give somewhat different data. The crystallinity of a vinylidene fluoride polymer used in the present invention is based on the values measured through the following method, wherein the crystallinity is obtained from a heat of fusion given by a melting heat absorption peak in a curve obtained with a differential scanning calorimeter (DSC). More specifically, about 20 mg of a sample is heated from 50° to 200° C. at a temperature raising rate of 10° C./min., and the heat of fushion ΔH (cal/g) of the sample is calculated from a ratio of the area of the melting peak measured at this time and that of indium as a reference. The crystallinity is calculated as $\Delta H/\Delta Hc \times 100$ (%) with the assumption that the heat of fusion for a complete crystal ΔHc is 15 cal/g. The vinylidene fluoride polymer used in the present invention should preferably have a crystallinity of 73% or more, particularly 76% or more.

The absolute β-crystal content of a vinylidene fluoride polymer is obtained by first measuring the crystallinity of the polymer according to the method as described above and multiplying the crystallinity with a proportion of β-crystal among the crystalline portion (α-crystal+β-crystal). The proportion of β-crystal can be obtained from an intensity ratio between diffraction lines for the α-crystal and β-crystal measured in an ordinary X-ray diffraction method or a peak ratio between peaks in the neighborhood of 530 $cm^{-1}$ and 510 $cm^{-1}$ which are characteristic absorptions for the α-crystal and β-crystal, respectively, in an infrared absorption spectrum.

The number-average particle size and weight-average molecular weight (Mw) of the vinylidene fluoride polymer containing β-crystal of the present invention may be measured according to the methods as described above.

The vinylidene fluoride polymer to be used in the invention satisfying the parameters described herein may be obtained by emulsion polymerization carried out at a relatively low temperature, i.e., 5°-10° C. lower than that conventionally used and by appropriate selection of emulsifiers and polymerization initiators.

The binder resin for the toner used in the present invention may be composed of homopolymers of styrene and substituted styrene such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-butyl methacrylate-dimethylaminoethyl methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and styrene-dimethylaminoethyl methacrylate copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, chlorinated paraffin, paraffin wax, carnauba wax, etc. These binder resins may be used either singly or as a mixture.

A colorant such as carbon black, copper phthalocyanine or iron black may optionally be used for a toner according to the present invention. A positive or negative charge control agent may optionally be used in the invention. A toner having a value-average particle size of 5-20μ, particularly 7-15μ is preferably used in view of the particle size of the fluorine-containing substance including vinylidene fluoride homopolymer or copolymer.

The toner according to the invention should preferably have a volume resistivity of $10^{10}$ Ω.cm or higher, particularly $10^{12}$ Ω.cm or higher so as to well acquire a triboelectric charge. Herein, the volume resistivity is defined as a calculated value obtained by molding a simple toner under a pressure of 100 $kg/cm^2$, applying an electric field of 100 V/cm to the molded toner, measuring a current after 1 minute from the initial application of the electric field and calculating a volume resistivity based on the current value.

The toner of the present invention may be mixed with carrier particles such as iron powder, glass beads, nickel powder or ferrite particles to form a two-component developer for developing electrical latent images. In this case, the carrier particles may be mixed in a proportion of 1 to 100 wt. parts per 1 wt. part of the toner.

The toner may be composed as a magnetic toner by incorporating therein magnetic powder. In this case, the magnetic powder also functions as a colorant. The magnetic powder to be used for this purpose may be powder of a magnetic material such as ferromagnetic metals inclusive of iron, cobalt and nickel, alloys of these metals, and compounds such as magnetite, $\gamma$-$Fe_2O_3$ and ferrite. In order to fully exhibit the above mentioned effects, the magnetic powder should preferably have a BET specific surface area according to the nitrogen adsorption method of 2 to 20 $m^2/g$, particularly 2.5 to 12 $m^2/g$ and a Mohs' hardness of 5 to 7. The magnetic powder may preferably be used in an amount of 10 to 70 wt.% of the toner.

Such magnetic powder, when contained in the developer according to the present invention, exhibits an abrasive effect, so that abnormal toner sticking onto a photosensitive member and damaging of a photosensitive member are suppressed to provide images having a high density and free of staining.

The toner may be produced by sufficiently kneading the ingredients thereof by means of hot kneading means such as hot rollers, kneader and extruder, cooling and mechnically crushing the mixture, and classifying the crushed product. Alternatively, another method may be used such as a method of dispersing in a solution of the binder resin the other prescribed ingredients and spray-drying the dispersion; or a suspension polymerization method of mixing in a monomer providing the binder resin the other prescribed ingredients to form a suspension and polymerizing the suspension to form a toner.

Further, it is desirable to add to the toner an inorganic powder having a BET specific surface area according to the nitrogen adsorption method of 0.5 to 500 $m^2/g$, particularly 50 to 400 $m^2/g$. This is because the above mentioned disturbance of latent images may be alleviated by the addition of such an inorganic powder. More specifically, it is considered that the above mentioned low resistivity substance attached to a photosensitive member may be removed by adsorption or attachment onto the inorganic powder because of the large specific surface area of the inorganic powder. The inorganic fine powder should preferably be powder or fine particles of a nonmagnetic inorganic material such as alumina, titanium dioxide, barium titanate, magnesium titanate, calcium titanate, strontium titanate, zinc oxide, siliceous sand, clay, mica, wollastonite, diatomaceous earth, silicon carbide, inorganic oxide pigments, chromium oxide, cerium oxide, rouge, antimony trioxide, magnesium oxide, zirconium oxide, barium sulfate, barium carbonate, calcium carbonate or silica. Among these, fine powder of metal titanates, silicon carbide and silica are particularly preferred.

Herein, silica fine powder is fine powder having an Si—O—Si bond and includes those produced by the dry method and the wet method. The silica fine powder may include fine powder of anhydrous silicon dioxide (silica) and also silicates such as aluminum silicate, sodium silicate, potassium silicate, magnesium silicate, and zinc silicate. The particle size of the silica fine powder should desirably be in the range of 0.01 to 2μ in terms of an average primary particle size. The silica fine powder should preferably be silica or silicate containing 85 wt% or more of $SiO_2$.

The developer according to the present invention shows further remarkable effects, when combined with hydrophobic colilidal silica. An ordinary polyvinylidene fluoride, when used together with silica fine powder, does not always have the silica fine powder show its effect sufficiently, probably because the silica fine powder is integrated with the polyvinylidene fluoride. In contrast thereto, according to the present invention, silica fine powder is appropriately dispersed among particles of a specific vinylidene fluoride polymer, and flowabilities of these particles are not mutually impaired but are enhanced with each other, so that a toner having excellent lubricity and dispersibility can be obtained, and the electrical characteristics of these particles are also improved mutually. These factors lead to an effect that a smaller amount of a vinylidene fluoride polymer still achieves the objective effect according to the invention.

As the photosensitive member used in combination with the developer of the invention, those of, e.g., cadmium sulfide, selenium, zinc oxide, organic photoconductor (OPC), and amorphous silicon (α-Si) may be used. Among these, a photosensitive member of an organic photoconductor (OPC) or amorphous silicon (α-Si) is particularly preferred to be used in combination with the developer according to the present invention.

As the cleaning method to be used in combination with the present invention, the blade cleaning method, the fur brush cleaning method or the magnetic brush cleaning method may be used, whereas the blade cleaning method is preferred when a suitable combination with the developer according to the invention and an appropriate photosensitive member to be used therewith are taken into consideration. There may be provided a charge removal step, as desired, immediately before the cleaning step in order to facilitate the toner cleaning.

Hereinabove, the basic features and characteristics of the present invention have been described. Hereinbelow, the present invention will be more specifically described with reference to examples. However, it is to be understood that the present invention is not limited by the examples. "Parts" and "%" in the examples are by weight unless otherwise noted specifically.

EXAMPLE 1

One hundred (100) parts of styrene-butyl methacrylate-dimethylaminoethyl methacrylate copolymer (monomer weight ratio=7:2.5:0.5) and 40 parts of magnetite having a BET specific surface area of 5 $m^2/g$ were blended and melt-kneaded on a roll mill at 160° C. After cooling, the kneaded product was coarsely crushed by a hammer mill and pulverized by a jet pulverizer. The pulverized product was classified by means of a wind-force classifier to recover black powder having a volume-average particle size of approximately 13 μm.

To 100 parts of the black powder were added 0.5% (about 0.5 part) of hydrophobic colloidal silica and 0.5% (about 0.5 part) of a polyvinylidene fluoride (Trade name: FORAFLON 1000 VLD mfd. by ATOCHEM SA, France) having a weight-average molecular weight of 300,000, a number-average particle size of 0.40μ and a repose angle of 28° to provide a developer. The vinylidene fluoride gave an NMR chart substantially the same as that for the developer which will be described hereinbelow.

The thus obtained developer was added to and mixed with $(CD_3)_2CO$. After removing unsoluble magnetite and other insolubles by filtration, the filtrate having a polymer concentration of about 120 mg/ml was subjected to a high resolving powder $F^{19}$-NMR to obtain a spectrum as shown in FIG. 1 in the drawing wherein 4 peaks due to chemical shifts were present at −23.5, −27.5, −45.8 and −48.1 ppm to provide a ratio, (Sb+Sc+Sd)/Sa of 0.214.

When the developer was used in a commercially available copying machine (trade name: NP-150Z, mfd. by Canon K.K.) using an OPC photoconductor and adopting the blade cleaning system to carry out 10,000 sheets of a running test, whereby clear images were stably obtained. A photography of a part of the thus obtained image on the final copy on copying of 10,000 sheets is shown as FIG. 2.

Figure 2:
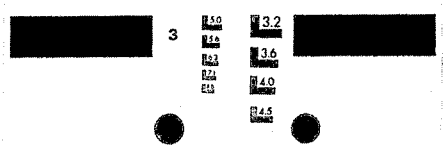
FIG. 2 is a photograph of a part of an image obtained in Example 1.

The developer was further subjected to similar running tests under the conditions of 30° C.—90% R.H. and 15° C.—10% R.H., whereby no staining of images due to disturbance of latent images or streaks due to insufficient cleaning were observed but good images similarly as that shown in FIG. 2 were obtained under either set of conditions. After the running tests, no flaw such as to interfere with development was observed on the photosensitive member.

EXAMPLE 2

To the black powder (toner) and the hydrophobic colloidal silica of Example 1 was added 0.3% of a polyvinylidene fluoride having a ratio (Sb+Sc+Sd)/Sa of 0.22, a number-average particle size of 0.25μ, a weight-average molecular weight of 450,000 and a repose angle of 27°, thereby to obtain a developer. The developer was subjected to running tests similarly as in Example 1, whereby good images were obtained in any sets of the conditions including the high temperature-high humidity and the low temperature-low humidity, similarly as in Example 1.

EXAMPLE 3

To the black powder (toner) and the hydrophobic colloidal silica of Example 1 was added 0.3% of a copolymer of vinylidene fluoride with trifluroethylene having a ratio (Sb+Sc+Sd)/Sa of 0.43, a number-average particle size of 0.30μ, and a weight-average molecular weight of 280,000, thereby to obtain a developer. The developer was subjected to running tests similarly as in Example 1, whereby good images were obtained in any sets of the conditions including the high temperature-high humidity and the low temperature-low humidity, similarly as in Example 1.

COMPARATIVE EXAMPLE 1

Figure 3:
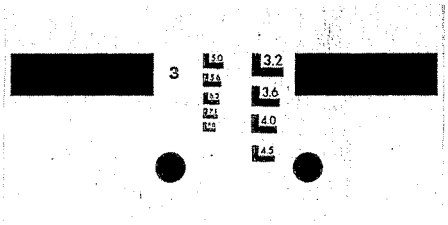
FIG. 3 is a photograph of a part of a poor image obtained in Comparative Example 1.

Example 1 was repeated except that 0.5% of polyvinylidene fluoride having a ratio (Sb+Sc+Sd)/Sa according to the NMR of 0.18, a number average particle size of 0.5μ, a weight-average molecular weight of 550,000, and a repose angle of 40° was used. As a result, poor images were obtained due to disturbance in latent images caused by insufficient cleaning of the OPC photosensitive member under the conditions of 30° C.—90% R.H. A photograph of a part of the thus obtained poor image showing a result of the insufficient cooling in the final copy on copying of 10,000 sheets is shown as FIG. 3.

COMPARATIVE EXAMPLE 2

Example 1 was repeated except that 0.4% of polyvinylidene fluoride having a ratio (Sb+Sc+Sd)/Sa according to the NMR of 0.07, an average particle size of 0.4μ, and an Mw of 550,000 was used. As a result, during running tests, the image density lowered, and poor images were produced under the conditions of 30° C.—90% R.H.

EXAMPLE 4

One hundred (100) parts of styrene-butyl methacrylate-dimethylaminoethyl methacrylate copolymer (monomer weight ratio=7:2.5:0.5) and 40 parts of magnetite having a BET specific surface area of 5 $m^2/g$ were blended and melt-kneaded on a roll mill at 160° C. After cooling, the kneaded product was coarsely crushed by a hammer mill and pulverized by a jet pulverizer. The pulverized product was classified by means of a wind-force classifier to recover black powder (toner particles) having a volume-average particle size of approximately 13 μm.

To 100 parts of the black powder were added 0.5% of hydrophobic colloidal silica and 0.5% of a polyvinylidene fluoride having a crystallinity of 79%, a weight-average molecular weight of 300,000, an average particle size of 0.25μ, a repose angle of 28°, and an absolute β-crystal content of 0.40 to provide a developer. The absolute β-crystal content was obtained through measurement of the β-crystal from a ratio between the infrared absorption peaks according to the KBr method by using an infrared absorption spectrometer Model IR-810 mfd. by Nihon Bunko K.K.

When the developer was used in a commercially availably copying machine (trade name: NP-150Z, mfd. by Canon K.K.) using an OPC photoconductor and adopting the blade cleaning system to carry out 10,000 sheets of a running test, whereby clear images were stably obtained. The developer was further subjected to similar running tests under the conditions of 30° C.—90% R.H. and 15° C.—10% R.H., whereby no staining of images due to disturbance of latent images or streaks due to insufficient cleaning were observed but good images similarly as that shown in FIG. 2 were obtained under either set of conditions. After the running tests, no flaw was observed on the photosensitive member.

EXAMPLES 5-8

To the black powder (toner) and positively chargeable hydrophobic colloidal silica used in Example 4 were respectively added vinylidene fluoride polymers having parameters as shown in the following table in the respectively indicated proportions to provide four developers. The developers were subjected to copying tests as described in Example 4, whereby good results were obtained under any sets of the conditions.

| | Vinylidene fluoride polymer | | | |
|---|---|---|---|---|
| Example | Absolute β-crystal content | Mw | Average particle size (μ) | Amount of addition (wt. %) |
| 5 | 0.31 | 210,000 | 0.31 | 0.5 |
| 6 | 0.72 | 320,000 | 0.28 | 1.5 |
| 7 | 0.72 | 320,000 | 0.28 | 0.05 |
| 8 | 0.97 | 340,000 | 0.25 | 0.5 |

EXAMPLE 9

Toner particles (black powder) were prepared in the same manner as in Example 4 except that a styrene-butyl methacrylate copolymer was used in place of the styrene-butyl methacrylate-dimethylaminoethyl methacrylate copolymer, and the magnetite was replaced by 3 parts by nigrosine and 5 parts of carbon black.

The toner particles in an amount of 100 parts were mixed with 900 parts of iron powder and 0.9% (based on the toner) of a vinylidene fluoride polymer having a crystallinity of 80%, an MW of 320,000, an average particle size of 0.4μ, and an absolute β-crystal content of 0.50, thereby to provide a developer.

When the developer was used in a commercially available copying machine adopting a two-component magnetic brush developing system, clear images were obtained. Further, good results were also obtained under the respective sets of conditions including 30° C.—90% R.H. and 15° C.—10% R.H.

EXAMPLE 10

To the black powder obtained in Example 4 was added a copolymer of vinylidene fluoride and trifluoroethylene having an absolute β-crystal content of 0.43, a number-average particle size of 0.32μ, an Mw of 280,000 to provide a developer. The developer was subjected to running tests whereby good images were stably obtained under the various sets of conditions including the high temperature-high humidity and the low temperature-low humidity.

COMPARATIVE EXAMPLE 3

Figure 4:
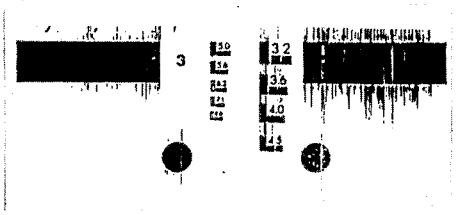
FIG. 4 is a photograph of a part of a poor image obtained in Comparative Example 3.

Example 4 was repeated except that 0.5% of a commercially available polyvinylidene fluoride having an absolute β-crystal content of 0.18, an average particle size of 0.5μ, an Mw of 560,000, and a repose angle of 43° was used, whereby streak-like contamination was found in the resultant images due to insufficient cleaning. A photograph of a part of the thus obtained poor image on the final copy on copying of 10,000 sheets is shown as FIG. 4.

What is claimed is:

1. A developer for developing electrostatic latent images, comprising toner particles and particles of a fluorine-containing substance, said fluorine-containing substance satisfying the relationship based on the $F^{19}$ nuclear magnetic resonance spectrum thereof in acetone of:

$$(Sb+Sc+Sd)/Sa \geqq 0.20,$$

wherein Sa, Sb, Sc and Sd are areas of absorption peaks at about −23.5±1 ppm, about −27.5±1 ppm, about −45.8±1 ppm, and about 48.1±1 ppm, respectively, with 1,1,2-trichloro-1,2,2-trifluoroethane as the reference substance.

2. A developer according to claim 1, wherein said fluorine-containing substance is a vinylidene fluoride polymer selected from the group consisting of homopolymer of vinylidene fluoride and a copolymer of vinylidene fluoride with ethylene, vinyl fluoride, trifluoroethylene or tetrafluoroethylene.

3. A developer according to claim 2, wherein said vinylidene fluoride polymer is contained in an amount of 0.01 to 2.0 wt.% of the toner.

4. A developer according to claim 2, wherein said vinylidene fluoride polymer has a weight-average molecular weight of 100,000 to 800,000.

5. A developer according to claim 4, wherein said vinylidene fluoride polymer has an average particle size of 0.05 to 1 μm.

6. A developer according to claim 1, which further comprises inorganic fine powder having a BET specific surface area according to the nitrogen adsorption method of 0.5 to 500 $m^2/g$.

7. A developer according to claim 6, wherein said inorganic fine powder is hydrophobic colloidal silica powder.

8. A developer according to claim 1, wherein said toner particles contain magnetic particles having a BET specific surface area according to the nitrogen adsorption method of 2 to 20 $m^2/g$ with a Mohs' hardness of 5–7, and hydrophobic colloidal silica powder is co-present with the fluorine-containing substance.

9. A developer according to claim 8, wherein said magnetic powder is contained in an amount of 10 to 70 wt.% of the toner.

10. A developer according to claim 1, which further comprises carrier particles.

11. A developer for developing electrostatic latent images, comprising toner particles and particles of a vinylidene fluoride polymer having an absolute β-crystal content of 0.30 or above.

12. A developer according to claim 11, wherein said vinylidene fluoride polymer is homopolymer of vinylidene fluoride or a copolymer of vinylidene fluoride with a monomer selected from the group consisting of vinyl fluoride, trifluroethylene, tetrafluoroethylene, ethylene, propylene and butene.

13. A developer according to claim 11, wherein said vinylidene fluoride polymer is contained in an amount of 0.01 to 20 wt.% of the toner.

14. A developer according to claim 11, wherein said vinylidene fluoride polymer has a weight-average molecular weight of 100,000 to 800,000.

15. A developer according to claim 11, wherein said vinylidene fluoride polymer has an average particle size of 0.05 to 1 μm.

16. A developer according to claim 11, which further comprises inorganic fine powder having a BET specific surface area according to the nitrogen adsorption method of 0.5 to 500 $m^2/g$.

17. A developer according to claim 16, wherein said inorganic fine powder is hydrophobic colloidal silica powder.

18. A developer according to claim 11, wherein said toner particles contain magnetic powder having a BET specific surface area according to the nitrogen adsorption method of 2 to 20 $m^2/g$ with a Mohs' hardness of 5–7, and hydrophobic colloidal silica powder is co-preset with the vinylidene fluoride polymer.

19. A developer according to claim 18, wherein said magnetic powder is contained in an amount of 10 to 70 wt.% of the toner.

20. A developer according to claim 11, which further comprises carrier particles.

* * * * *

UNITED STATES PATENT AND TRADEMARK OFFICE

CERTIFICATE OF CORRECTION

PATENT NO. : 4,666,813

DATED : May 19, 1987

INVENTOR(S) : KIICHIRO SAKASHITA

It is certified that error appears in the above-identified patent and that said Letters Patent is hereby corrected as shown below:

COLUMN 14

Line 7, "trifluroethylene," should read --trifluoroethylene,--.

Line 30, "set" should read --sent--.

Signed and Sealed this

Twenty-ninth Day of September, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,666,813

DATED : May 19, 1987

INVENTOR(S) : KIICHIRO SAKASHITA

It is certified that error appears in the above-identified patent and that said Letters Patent is hereby corrected as shown below:

COLUMN 2

Line 40, "48.1" should read -- -48.1 --.

COLUMN 12

Line 66, "48.1" should read -- -48.1 --.

Signed and Sealed this

Seventeenth Day of January, 1989

*Attest:*

DONALD J. QUIGG

*Attesting Officer*

*Commissioner of Patents and Trademarks*